US010550336B2

(12) United States Patent
Voolapalli et al.

(10) Patent No.: US 10,550,336 B2
(45) Date of Patent: Feb. 4, 2020

(54) METHODS FOR CATALYTIC CRACKING

(71) Applicant: BHARAT PETROLEUM CORPORATION LIMITED, Mumbai (IN)

(72) Inventors: Ravi Kumar Voolapalli, Greater Noida (IN); Seetaram Chebrolu, Greater Noida (IN); Biswanath Saha, Greater Noida (IN)

(73) Assignee: BHARAT PETROLEUM CORPORATION LIMITED, Mumbai (IN)

( * ) Notice: Subject to any disclaimer, the term of this patent is extended or adjusted under 35 U.S.C. 154(b) by 846 days.

(21) Appl. No.: 14/958,410

(22) Filed: Dec. 3, 2015

(65) Prior Publication Data

US 2016/0160134 A1 Jun. 9, 2016

(30) Foreign Application Priority Data

Dec. 3, 2014 (IN) ..... 3526/DEL/2014

(51) Int. Cl.
*C10G 51/02* (2006.01)
*C10G 11/14* (2006.01)

(52) U.S. Cl.
CPC ..... *C10G 51/026* (2013.01); *C10G 11/14* (2013.01)

(58) Field of Classification Search
CPC ..... C10G 11/14; C10G 2300/1033; C10G 2300/1074; C10G 2300/4056; C10G 51/026
See application file for complete search history.

(56) References Cited

U.S. PATENT DOCUMENTS 2,430,784 A * 11/1947 Ruthruff ..... B01J 8/0453 208/80
2009/0099006 A1* 4/2009 Bezerra De Almeida ..... B01J 29/06 502/64
2013/0338418 A1* 12/2013 Xu ..... C07C 4/06 585/400

OTHER PUBLICATIONS

Parkash, S., Refining Processes Handbook, 2003, Gulf Pub., pp. 109-152. (Year: 2013).*

* cited by examiner

*Primary Examiner* — Renee Robinson
*Assistant Examiner* — Derek N Mueller
(74) *Attorney, Agent, or Firm* — Hamre, Schumann, Mueller & Larson, P.C.

(57) ABSTRACT

The present disclosure provides methods and apparatus for catalytic cracking of hydrocarbon feed. The apparatus includes a plurality of stages, wherein hydrocarbon feed is introduced into a bottom stage reactor and flows in an overall upward direction. A reaction catalyst stream is introduced into a top stage reactor and flows in an overall downward direction. In each of the stages, the hydrocarbon feed is allowed to come in contact with the reaction catalyst stream received at the particular stage for cracking of the hydrocarbon feed. The final cracked product stream is obtained at an outlet of the top stage reactor and a final spent catalyst stream is obtained at an outlet of the bottom stage reactor.

15 Claims, 5 Drawing Sheets

400b

METHODS FOR CATALYTIC CRACKING

TECHNICAL FIELD

The present invention relates to catalytic cracking and, in particular, relates to catalytic cracking of hydrocarbon feed.

BACKGROUND

Catalytic cracking is a chemical process that is carried out by contacting the hydrocarbon feed, such as a vacuum gas oil or crude oil, with a hot regenerated catalyst, such as composed of finely divided or particulate solid material, in a catalytic reactor. Such a contact of the hot regenerated catalyst with the hydrocarbon feed causes cracking of the hydrocarbon feed into smaller molecules, such as light olefins and other lighter hydrocarbons. Further, the catalytic cracking process results in deposition of coke on the catalyst, as a result of which the catalyst loses its activity. Therefore, the catalyst can be regenerated by burning with air or any oxygen containing gases in a regenerator to obtain the regenerated catalyst. This process is commercially employed in the petroleum refining industry to produce products, such as light olefins of high economic value from the hydrocarbon feed of low economic value.

BRIEF DESCRIPTION OF DRAWINGS

The detailed description is described with reference to the accompanying figures. In the figures, the left-most digit(s) of a reference number identifies the figure in which the reference number first appears. The same numbers are used throughout the drawings to reference like features and components.

DETAILED DESCRIPTION

Figure 1:
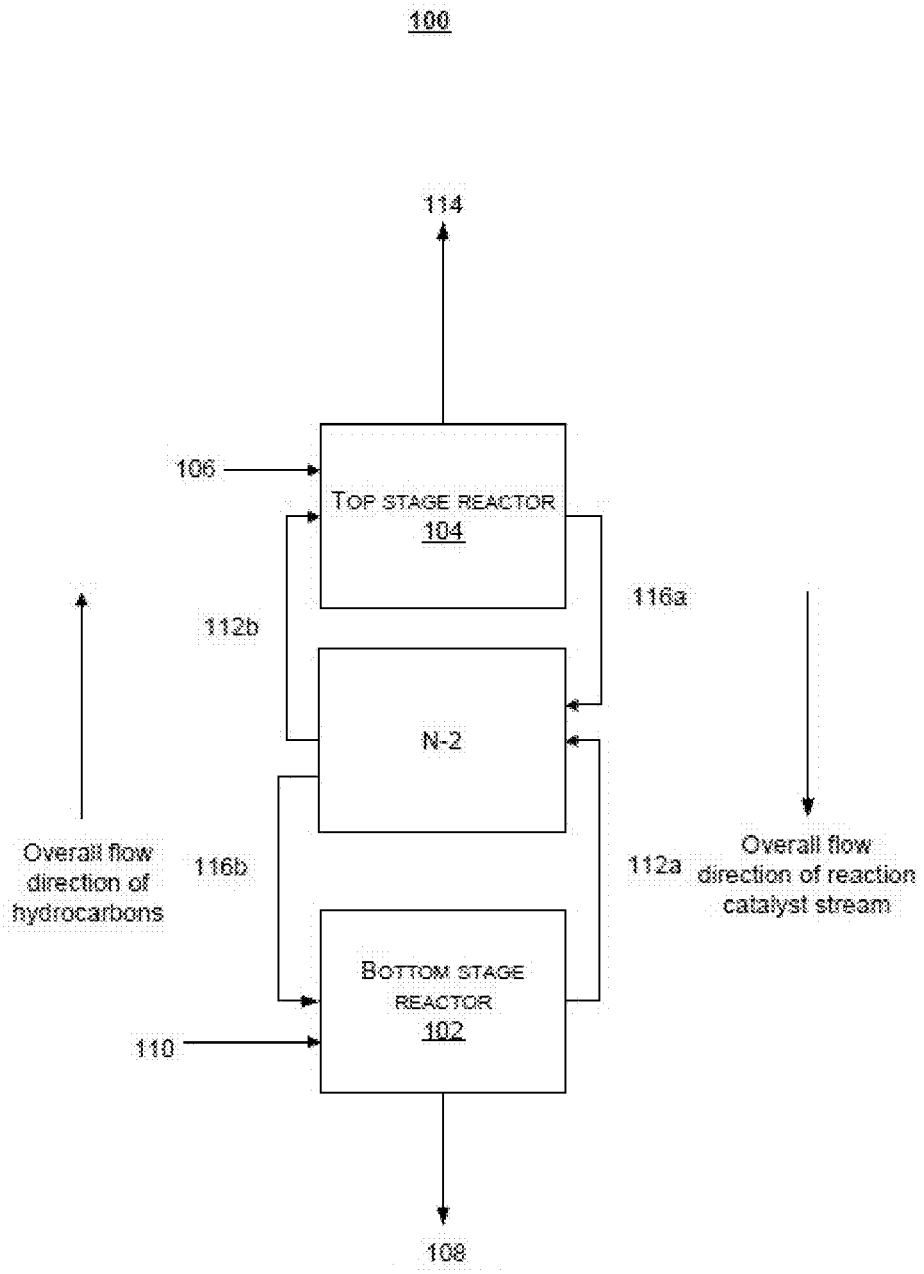
FIG. 1 illustrates a schematic representation of an assembly and method for fluid catalytic cracking of a hydrocarbon feed, in accordance with an implementation of the present subject matter.

Method(s) and apparatus relating to catalytic cracking of hydrocarbon feed are described. The hydrocarbon feed may include gasoline, light gas oils, residual oils, naphtha, and the like. The catalytic cracking of the hydrocarbon feed is for the production of light olefins. In an example, the light olefins include olefins with six or less carbon atoms, such as ethylene, propylene, and butylene. Further, the catalytic cracking reactions are performed in a catalytic reactor, during which the catalytic reaction conditions, such as temperature, contact time of the catalyst with the hydrocarbon feed, and catalyst-to-oil ratio, may be controlled, in order to favor the formation of desired products, such as light olefins, and minimize the formation of less desirable products, such as light gases and coke.

In one conventional method, a co-current riser configuration is employed for the production of light olefins. In this method, the hydrocarbon feed comes in contact with the catalyst at the bottom of a riser and both the hydrocarbon feed and the catalyst flow upward together within the riser to generate a cracked product containing hydrocarbons, including light olefins and coked catalyst. The cracked product is at a maximum temperature in the bottom zone, thereafter which the temperature drops during the upward passage of the cracked product due to endothermic cracking reactions along the length of the catalytic reactor. The cracked product exits out of an end of the riser and the cracked product containing hydrocarbons and light olefins are then separated from the coked catalyst. However, since the temperatures at which the cracked product exits from the riser are low and also because of the greater contact time of the catalyst with the hydrocarbon feed, there is a substantial amount of dry gas formation due to hydrogen transfer reactions, thereby limiting the production of light olefins.

In yet another conventional method, a co-current downer configuration is employed for the production of light olefins. In this configuration, the hydrocarbon feed and the catalyst particles are introduced from the top of the downer and they flow downwards together. Due to higher velocity of the catalyst, its contact time is relatively lower, resulting in reduced hydrogen transfer reactions, higher light olefins yields, and reduced coke make production. However, in both co-current configurations, i.e., the riser and the downer, the fresh feed contacts with hot regenerated catalyst. As a result, the possibility of thermal cracking is very high over catalytic cracking, which may result in undesirable products being generated. Further, in the co-current configuration, the temperature drops gradually as the cracked product rises upwards or flows downwards, due to the progression of endothermic cracking reactions along the length of the catalytic reactor. As a result, there may be dry gas formation due to hydrogen transfer reactions, thus lowering the yield of light olefins.

The present subject matter describes methods and apparatus for catalytic cracking of hydrocarbon feed for production of light olefins, such as ethylene, propylene, and butylene. The hydrocarbon feed may include gasoline, light gas oils, residual oils, naphtha, and the like.

According to an implementation of the present subject matter, a multi-stage counter-current method and assembly to perform catalytic cracking of hydrocarbon feed for the production of light olefins is described. Further, according to said implementation, methods for obtaining light olefins in a multi-stage cyclone reactor are also described. The described methods, on one hand allow a short contact time between the catalyst and the hydrocarbon feed, thereby reducing the hydrogen transfer reactions and secondary cracking reactions; and on the other hand provide greater yield of light olefins. Moreover, in countercurrent operation in the multi-stage countercurrent scheme, the product stream temperature is highest since it comes in contact with the hot catalyst stream. Since the exiting product stream is olefins rich, the higher temperatures help in achieving higher equilibrium olefin yields. Further, due to overall countercurrent flow of catalyst and feed, olefins richer stream comes in contact with increasingly higher catalyst temperatures at every stage. Such a contacting pattern is optimal from thermodynamic perspective for attaining maximum driving force for olefins production.

The present subject matter provides for production of light olefins through a catalytic cracking process. In the present subject matter of counter-current assembly and method for fluid catalytic cracking disclosed herein, a hydrocarbon feed is introduced into a bottom stage of a plurality of stages, wherein the hydrocarbon feed flows, upon cracking, successively from the bottom stage to a next stage in an upward direction; a reaction catalyst stream introduced into a top stage, wherein the reaction catalyst stream flows successively, from the top stage to the next stage in a downward direction, such that the overall flow of the reaction catalyst stream is countercurrent to the flow of the hydrocarbon feed. It will be understood that the catalyst stream comprises catalyst and appropriate additives, such as shape selective and bottom cracking additives, as known in the art. Each of the stages is associated with a reactor. The hydrocarbon feed is allowed to come in contact with the reaction catalyst stream, in each of the plurality of stages, to produce a cracked product and a spent reaction catalyst stream, wherein a final cracked product stream is obtained at an outlet of the top stage reactor and a final spent catalyst stream is obtained at an outlet of the bottom stage reactor. Further, at a particular reactor in a stage, the catalyst stream and the hydrocarbon feed may be introduced as co-current streams. However, the overall flow of the catalyst stream and the hydrocarbon feed through the multi-stage reactor assembly is counter-current as will be described below.

The present subject matter relates to catalytic cracking of hydrocarbon feed in a multi-stage counter current assembly. The hydrocarbon feed includes hydrocarbon feed such as naphtha and the like. Although, the description is provided with reference to two stages for catalytic cracking of hydrocarbon feed, it may be understood that the number of stages maybe more than two, as may be understood by a person skilled in the art.

FIG. 1 illustrates a schematic 100 representation of an assembly and method for fluid catalytic cracking of a hydrocarbon feed 110, in accordance with an implementation of the present subject matter. The schematic 100 comprises of a plurality of reactor stages N. In the schematic 100, hydrocarbon feed 110 is introduced into a bottom stage reactor 102 of a plurality of reactor stages N, wherein the hydrocarbon feed 110 flows successively from the bottom stage to a top stage in an upward direction. A reaction catalyst stream 106 is introduced into a top stage reactor 104 of the plurality of reactor stages N, wherein the reaction catalyst stream 106 flows successively from the top stage to the bottom stage in a downward direction. In each of the plurality of stages N, the hydrocarbon feed 110, which is received at a reactor associated with that stage, is allowed to come in contact with the reaction catalyst stream 106 received at the particular reactor stage for cracking of the hydrocarbon feed 110. The hydrocarbon feed 110 including cracked products 112 (112*a*, 112*b*) is allowed to exit the particular reactor in the upward direction to the next stage reactor; and the reaction catalyst stream 106, including spent catalyst 116 (116*a*, 116*b*), is allowed to exit the particular reactor in the downward direction to the next stage reactor. Accordingly, a final cracked product stream 114 is obtained at an outlet of the top stage reactor 104 and a final spent catalyst stream 108 is obtained at an outlet of the bottom stage reactor 102.

Further, as can be seen from schematic 100, at each stage, the catalyst stream and the hydrocarbon feed may be introduced in a co-current manner. However, the overall flow of the catalyst stream and the hydrocarbon feed is counter current since the catalyst stream is introduced at the top stage reactor and spent catalyst is obtained from the bottom stage reactor, while the hydrocarbon feed is introduced at the bottom stage reactor and the cracked products are obtained from the top stage reactor.

The number of stages involved in the catalytic cracking process as described above may be determined based on the feed quality, catalyst being used, and the required targeted product. Each of the plurality of stages N is associated with a reactor, wherein the reactor can be a cyclone reactor, a riser, a downer, or a fixed fluid bed reactor. The plurality of stages N can be operated between temperatures of 500° C. to 700° C., with the temperatures at each stage being independently controllable to ensure optimal cracking. For example, the temperature in the top stage may be highest while that at the bottom stage may be lowest. The contact time at each stage may be maintained between 1-4 seconds, with the contact time at each stage being independently controllable to ensure optimal cracking. For example, the contact time in the top stage may be lowest while that at the bottom stage may be highest. In one example, the contact time in the reactors can be varied based on the flow rate of the hydrocarbon feed and catalyst streams and the length of the reactors. For example, if a downer is used, the contact time in the downer can be managed by varying the length of the downer. In case a riser is used, the riser may be operated either in pneumatic conveying, fast fluidization, or turbulent bed regimes, wherein the pneumatic conveying provides lowest contact time, turbulent bed provides highest contact time and fast fluidization provides an intermediate contact time. In case a fixed fluid bed reactor is used, the fixed fluid bed reactor may be operated in either particulate or bubbling regime.

It will be understood that the position of introduction and exit of the catalyst stream and the hydrocarbon feed at each stage may depend on the type of reactor used at the stage and the schematic 100 is merely for illustration and not as limitation. For example, if a cyclone reactor is used, the catalyst stream and the hydrocarbon stream may be introduced from a side of the reactor and the catalyst stream exit may be at the bottom of the reactor while the hydrocarbon feed exit may be from the top of the reactor. In another example, if a downer is used, the catalyst stream and the hydrocarbon stream may be introduced from a top of the reactor and the exit may be at the bottom. In this example, after the exit, a solid gas separator may be used to separate the catalyst stream and the hydrocarbon feed, which may then be sent to the respective next stages. In yet another example, if a riser is used, the catalyst stream and the hydrocarbon stream may be introduced from a bottom of the reactor and the exit may be at the top. In this example also, after the exit, a solid gas separator may be used to separate the catalyst stream and the hydrocarbon feed, which may then be sent to the respective next stages. In a further example, if a fixed fluid bed reactor is used, then the catalyst stream may be introduced from a side of the reactor and exited from the bottom, while the hydrocarbon feed may be introduced from the bottom of the reactor and exited from the top. As will be understood, a fixed fluid bed reactor refers to a fluidized bed reactor having a fixed bed size. In this example of fixed fluid bed reactor, the introduction and flow of the catalyst stream and the hydrocarbon feed in the reactor would be counter-current.

Figure 2:
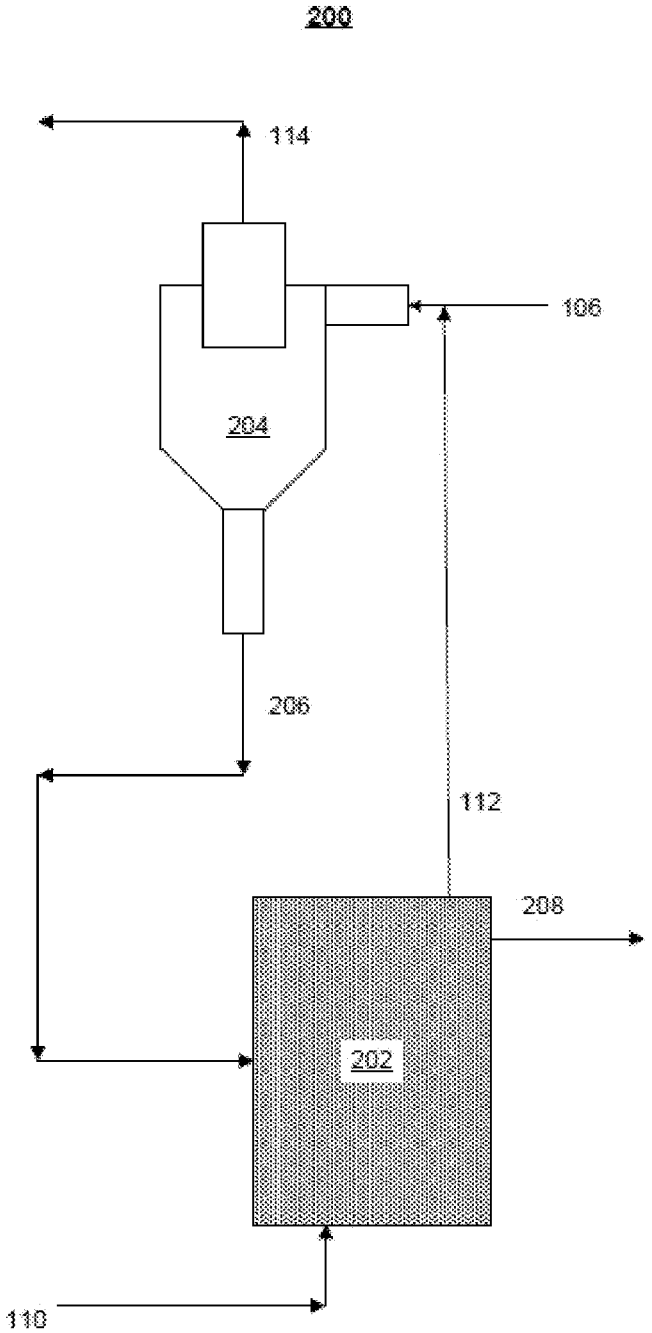
FIG. 2 illustrates an example counter current assembly for catalytic cracking of hydrocarbon feed, in accordance with an implementation of the present subject matter.

FIG. 2 illustrates an example counter-current, multi-stage assembly 200 for fluid catalytic cracking of the hydrocarbon feed, in accordance with an implementation of the present subject matter. In the assembly 200, the top reactor and the bottom reactor are operable at a first pre-determined temperature and second pre-determined temperature, and wherein the second pre-determined temperature is lesser than the first pre-determined temperature. In the assembly 200, reactors are a cyclone reactor 204 and a fluid bed reactor 202, wherein the cyclone reactor corresponds to top stage 104 and the fluid bed reactor corresponds to bottom stage 102 respectively. It will be understood that there may be other reactor stages in between the two as discussed above, but are not shown here for brevity and ease of explanation.

The hydrocarbon feed 110 enters the assembly through an inlet of the fluid bed reactor 202 and the reaction catalyst stream 106 enters through an inlet of the cyclone reactor 204. As the hydrocarbon feed 110 and the reaction catalyst stream 106 move in a counter current fashion, they come in contact and the hydrocarbon feed cracks to form a partially cracked hydrocarbon vapor stream 112 which exits out of the top of the fluid bed reactor 202. The spent reaction catalyst stream 208 moves from the fluid bed reactor 202 to a regenerator.

The regenerated catalyst is again recirculated to the cyclone reactor 204. Therefore, the reaction catalyst stream 106 can include fresh reaction catalyst stream, regenerated reaction catalyst stream or a combination. In the cyclone reactor 204, the partially cracked hydrocarbon vapor stream 112 and the reaction catalyst stream 106 enter in a co-current manner. It is to be noted that the partially cracked hydrocarbon vapor stream 112 and the reaction catalyst stream 106 can enter the cyclone reactor 204 even in a counter current manner. Within the cyclone reactor 204, the partially cracked hydrocarbon stream 112 and the reaction catalyst stream 106 come in contact, causing further cracking of the partially cracked hydrocarbon stream 112. The final cracked product stream 114 exits from the top of the cyclone reactor 204 whereas the separated solid catalyst stream 206 exits from the bottom of the cyclone reactor 204 and enters into the fluid bed reactor 202 to crack fresh hydrocarbon feed 110. In this way, the fresh hydrocarbon feed 110 comes in contact with the spent solid catalyst stream 206 and the final cracked product stream 114 comes in contact with reaction catalyst stream 106 which may include fresh reaction catalyst stream, regenerated reaction catalyst stream or a combination.

Figure 3:
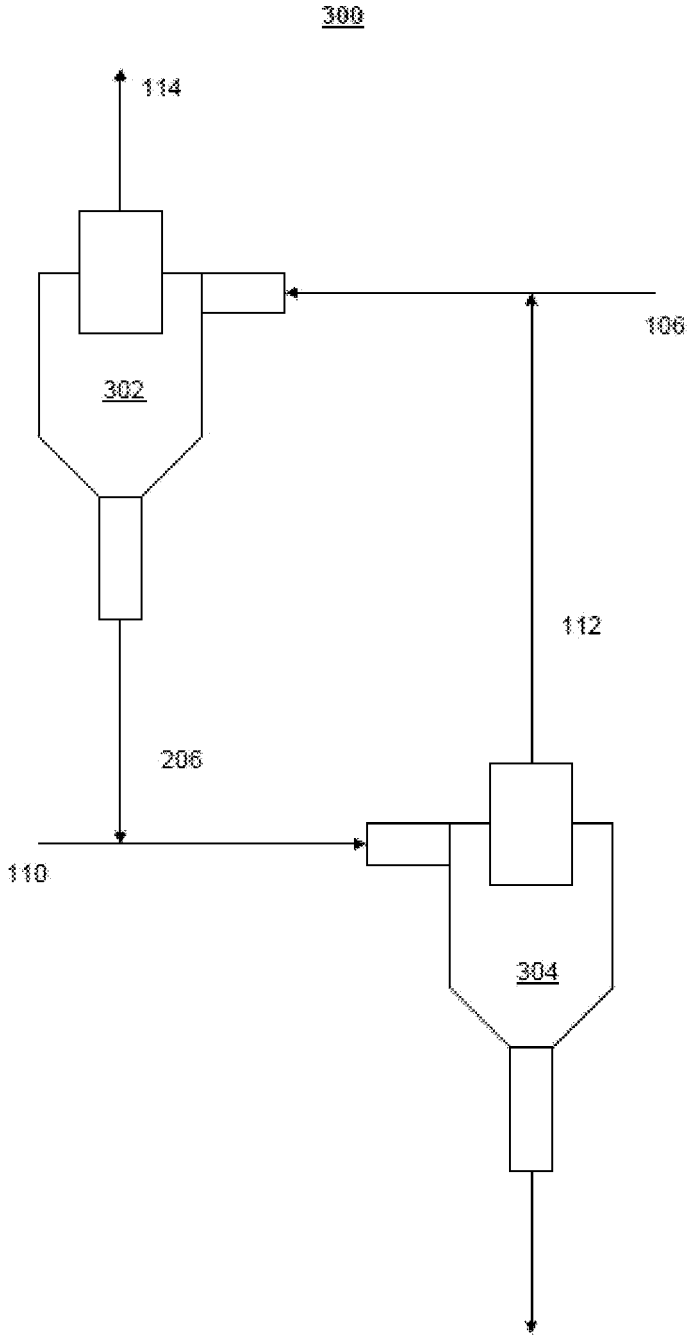
FIG. 3 illustrates an example counter current assembly for catalytic cracking of hydrocarbon feed, in accordance with another implementation of the present subject matter.

FIG. 3 illustrates an example counter-current, multi-stage assembly 200 for fluid catalytic cracking of the hydrocarbon feed, in accordance with an implementation of the present subject matter. In the assembly 300, the top reactor and the bottom reactor are operable at a first pre-determined temperature and second pre-determined temperature, and wherein the second pre-determined temperature is lesser than the first pre-determined temperature. In the assembly 300, reactors are cyclone reactors 302 and 304 in series, wherein the cyclone reactor 302 corresponds to top stage 104 and the cyclone reactor 304 corresponds to bottom stage 102 respectively. It will be understood that there may be other reactor stages in between the two as discussed above, but are not shown here for brevity and ease of explanation. The final cracked product stream 114 exits from the top of the cyclone reactor 302 whereas the spent reaction catalyst stream 208 moves from the cyclone reactor 304 to a regenerator.

Figure 4A:
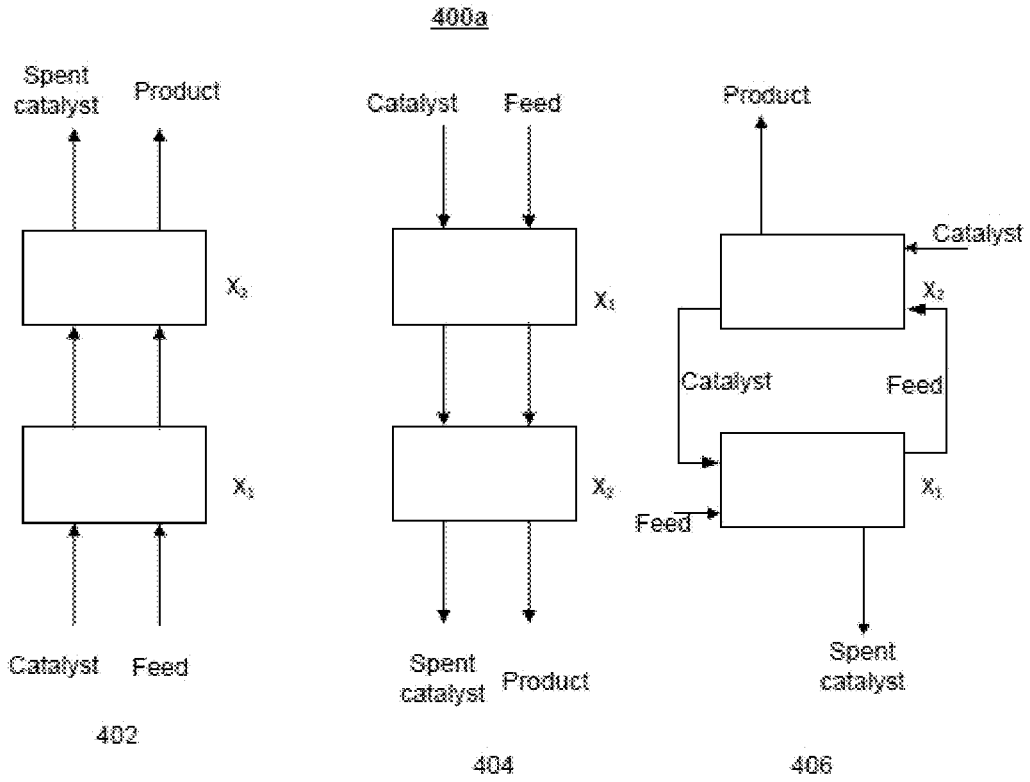
FIG. 4*a* illustrates comparative schematics of catalyst and feed contact patterns in conventional riser, conventional downer, and counter-current multi-stage configuration that is in accordance with an implementation of the present subject matter.
Figure 4B:
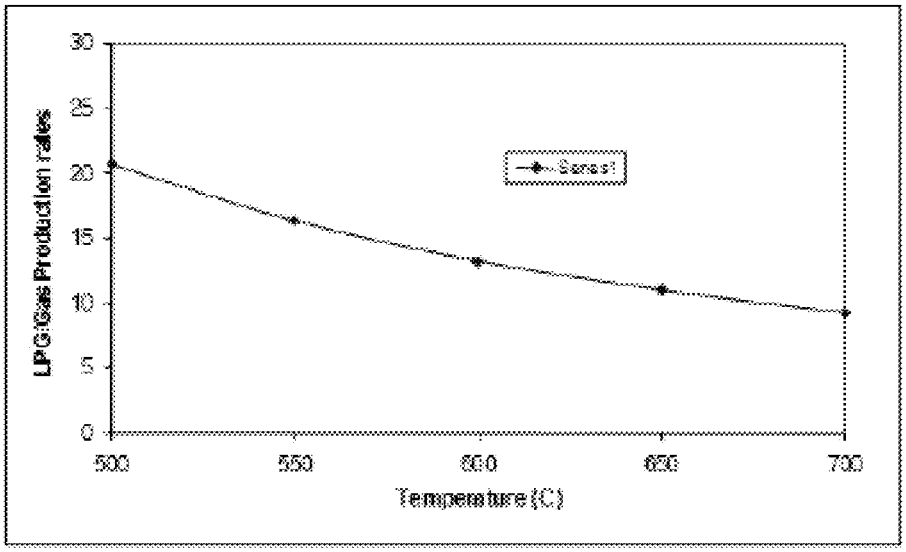
FIG. 4*b* illustrates a graph showing the ratio of relative rates of LPG or gas production from gasoline with change in reactor temperature.

Referring to FIG. 4*a*, for discussion purposes, consider a two stage reactor system, in series, operating in co-current modes as per conventional configurations and a countercurrent mode as per the present subject matter, with identical feed conversion. The co-current reactors can be a conventional riser 402 or a conventional downer 404. The countercurrent reactors system can be the multi-stage countercurrent reactor 406 as shown in FIG. 4*a*. The advantage of the multi-stage countercurrent reactor scheme 402, 404 over conventional co-current schemes can be understood with help of the graph illustrated in FIG. 4*b* and example computations presented below. FIG. 4*b* illustrates a graph 400*b* showing the ratio of relative rates of LPG or Gas production from gasoline with change in reactor temperature. These calculations were made theoretically based on literature kinetics and are applicable to all reactor configurations. As is known, dry gas yield increases with increase in temperature, resulting in lower LPG selectivity at higher temperatures. Also, at lower temperatures the rate of gas production is less due to higher activation energy compared to LPG production.

Assume the reactor temperatures in the two stages to be 500° C. and 600° C. in both co-current and countercurrent cases. At these temperatures the selectivity of LPG production over gas production varies from 21 to 13. Also assume the total conversion (X) is same in both the configurations. The total conversion X is equal to sum of fractional conversions $X_1$ and $X_2$ in reactor 1 and 2 respectively. Reactor 1 temperature is 500° C. while the reactor 2 is 600° C.

$$\text{Thus, } X=X_1+X_2 \tag{1}$$

$$\text{Therefore, average LPG production rate/gas production rate}=21X_1+13X_2 \tag{2}$$

The equation (3) given below suggests operating with maximal conversion ($X_1$) in reactor 1, i.e. cracking at lower temperature, will result in more LPG and less gas make. In countercurrent mode of operation $X_1$ is always higher than in co-current mode. This is because the reaction rate with fresh feed is higher than partially converted feed, i.e.

$$\text{Reaction rate}=K_1(\text{kinetic constant})*(\text{Concentration of feed}) \tag{3}$$

In countercurrent mode fresh feed comes in contact with cooler catalyst where as in concurrent mode fresh feed sees the hot catalyst. Hence, for countercurrent mode the selectivity towards LPG is expected to be higher.

EXAMPLES

All the experimental runs were conducted in a commercially available lab scale fixed fluid bed reactor setup. These examples compare different reaction conditions to identify those that favor greater production of the desired reaction products. Table-1 gives properties of feeds used in all the experimental runs.

TABLE 1

| Feed characteristics | | |
|---|---|---|
| Feed | Density (gram/cc) | BP (IBP/FBP) |
| UCO | 0.8560 | 375/565 |
| Mid-cut Gasoline | 0.7552 | 90/120 |
| VGO | 0.9073 | 359/580 |

Example—1

This example illustrates the effect of reaction temperature, on light olefin yields. Feed UCO is cracked at 580° C. and 620° C. using a catalyst mixture contains 90% equilibrium catalyst (Cat-R) and 10% shape selective ZSM-5. WHSV=8

$hr^{-1}$. It can be observed that there is 20% increase in light olefin yields can be obtained by operating at 40° C. higher temperatures.

TABLE 2

Temperature effect on product yields

| Feed | UCO | UCO |
|---|---|---|
| T ° C. | 580 | 620 |
| C/O | 9 | 9 |
| WHSV ($hr^{-1}$) | 8 | 8 |
| Cat Wt | 9 | 9 |
| Base Cat | Cat-R | Cat-R |
| Additive in catalyst stream | 10% | 10% |
| Yield wt % | | |
| $H_2$ | 0.05 | 0.10 |
| Methane | 0.94 | 3.59 |
| Ethane | 0.72 | 2.18 |
| Ethylene | 5.89 | 10.75 |
| Propane | 3.66 | 4.06 |
| Propylene | 18.17 | 22.65 |
| n-butane | 1.69 | 1.31 |
| Isobutane | 6.31 | 3.92 |
| Isobutylene | 4.36 | 4.47 |
| C-2 butene | 3.44 | 3.36 |
| t-2 butene | 1.74 | 1.60 |
| Gasoline (C5-220° C.) | 42.01 | 35.63 |
| CO (220-370° C.) | 5.49 | 2.09 |
| CLO (>370° C.) | 2.52 | 1.09 |
| Coke | 3.12 | 3.27 |

Example—2

This example illustrates the effect of feed stocks having different boiling ranges on light olefin yields. Three different feeds stocks gasoline. Unconverted oil (UCO) and Vacuum gas Oil (VGO) were cracked using catalyst mixture contains 90% equilibrium catalyst (Cat-R) and 10% shape selective ZSM-5 at WHSV=8 $hr^{-1}$ at 620° C. At the run conditions studied light olefins yield is high with UCO.

TABLE 3

Effect of feed on product yields

| Feed | UCO | Gasoline (Mid-cut) | VGO |
|---|---|---|---|
| T ° C. | 620 | 620 | 620 |
| C/O | 9 | 9 | 9 |
| WHSV($hr^{-1}$) | 8 | 8 | 8 |
| Cat Wt (grams) | 9 | 9 | 9 |
| Base Cat | Cat-R | Cat-R | Cat-R |
| Additive in catalyst stream | 10% | 10% | 10% |
| Yields (wt %) | | | |
| $H_2$ | 0.10 | 0.08 | 0.11 |
| Methane | 3.59 | 3.55 | 3.88 |
| Ethane | 2.18 | 2.45 | 2.24 |
| Ethylene | 10.75 | 8.56 | 9.43 |
| Propane | 4.06 | 3.18 | 2.64 |
| Propylene | 22.65 | 19.44 | 18.77 |
| n-butane | 1.31 | 0.71 | 0.80 |
| Iso-butane | 3.92 | 2.07 | 1.58 |
| Isobutylene | 4.47 | 2.98 | 3.55 |
| C-2 butene | 3.36 | 1.87 | 2.66 |
| t-2 butene | 1.60 | 1.07 | 1.24 |
| Gasoline (C5-220° C.) | 35.63 | 51.16 | 33.68 |
| CO (220-370° C.) | 2.00 | 0.74 | 6.90 |
| CLO (>370° C.) | 1.09 | 0.00 | 5.51 |
| Coke | 3.27 | 2.15 | 7.03 |

Example—3

This example illustrates the effect of residence time (time on stream TOS) on light olefin yield. TOS is the time over which feed is injected into the catalyst bed. The tests were carried out in a lab scale fixed fluid bed reactor at constant temperature of 580° C., Cat-to-oil ratio of 20, catalyst stream consists of mixture of 80% equilibrium catalyst and 20% shape selective additive ZSM-5 and variable feed rates of 2.25 and 1.2 grams/min. As shown in table 4, by operating at 46% lower TOS, coke yield was reduced by 23% and DG ($H_2$, Methane, Ethane and Ethylene) yield was reduced by 27%.

TABLE 4

Effect of TOS on product yields

| Feed | UCO | UCO |
|---|---|---|
| T ° C. | 580 | 580 |
| C/O | 20 | 20 |
| TOS (sec)/WHSV($hr^{-1}$) | 16/11.25 | 30/6 |
| Cat Wt (grams) | 12 | 12 |
| Base Cat | Cat-A | Cat-A |
| Additive in catalyst stream | 20% | 20% |
| Yields (wt %) | | |
| $H_2$ | 0.02 | 0.05 |
| Methane | 1.17 | 1.83 |
| Ethane | 0.93 | 1.52 |
| Ethylene | 6.99 | 9.13 |
| Propane | 4.80 | 6.35 |
| Propylene | 19.13 | 19.70 |
| n-butane | 2.02 | 2.17 |
| Iso-butane | 7.87 | 8.13 |
| Isobutylene | 4.46 | 4.23 |
| C-2 butene | 3.47 | 3.26 |
| t-2 butene | 1.86 | 1.76 |
| Gasoline (C5-220° C.) | 39.21 | 31.30 |
| CO (220-370° C.) | 2.43 | 3.87 |
| CLO (>370° C.) | 1.45 | 1.28 |
| Coke | 4.18 | 5.42 |

Example—4

This example illustrates the advantages of the proposed two stage countercurrent scheme where the fresh feed undergoes reaction with spent catalyst and partially reacted feed is further cracked with regenerated/fresh catalyst. For example, in the proposed two stage countercurrent scheme, in the first reactor, fresh UCO feed may be catalytically cracked at 540° C. with spent catalyst and the cracked product can be further catalytically cracked in the second reactor at 580° C. with regenerated catalyst.

To validate that the above scheme can produce higher amounts of lighter olefin than conventional co-current schemes, two experimental runs were conducted at 540° C. and 580° C. using spent catalysts and same was repeated with regenerated catalyst. Spent catalyst having known carbon content was used in this example and yields were adjusted based on actual coke make, i.e., total coke burned—coke on spent catalyst. As shown in table 5, it was found that propylene per unit coke, propylene per unit LPG, and propylene per unit second order conversion is double in case of spent catalyst over regenerated catalyst at same temperature. Thus, it is validated that when feed having more crackable hydrocarbons is cracked at low temperatures with catalyst having suitable pore structure (spent catalyst), it increases selectivity of light olefins. UCO is feed in these experimental runs. As shown in table 5, spent catalyst is giving more propylene than regenerated catalyst at both the temperatures. This is due to the fact that the pore structure of spent catalyst which is different from regenerated catalyst and is suitable for producing more light olefins. It was also found that propylene per unit coke, propylene per unit LPG, and propylene per unit second order conversion is double in case of spent catalyst over regenerated catalyst at same temperature.

TABLE 5

Effect of spent vs. regenerated catalyst on product yields

| Feed | UCO | UCO | UCO | UCO |
|---|---|---|---|---|
| T ° C. | 540 | 540 | 580 | 580 |
| C/O | 9 | 9 | 9 | 9 |
| WHSV ($hr^{-1}$) | 15 | 15 | 15 | 15 |
| Cat Wt | 9 | 9 | 9 | 9 |
| Base Cat | Spent cat | Regen. cat | Spent cat | Regen. cat |
| Additive | 10% | 10% | 10% | 10% |
| | Yields (wt %) | | | |
| $H_2$ | 0.03 | 0.03 | 0.04 | 0.04 |
| Methane | 0.42 | 0.49 | 0.87 | 1.10 |
| Ethane | 0.53 | 0.75 | 0.94 | 0.97 |
| Ethylene | 5.19 | 5.86 | 7.28 | 7.82 |
| Propane | 4.25 | 3.55 | 4.51 | 5.24 |
| Propylene | 17.68 | 16.19 | 21.55 | 20.12 |
| n-butane | 2.22 | 2.00 | 2.00 | 2.19 |
| Isobutane | 8.41 | 10.55 | 6.41 | 8.37 |
| Isobutylene | 4.40 | 4.00 | 4.84 | 4.37 |
| C-2 butene | 3.58 | 3.25 | 3.81 | 3.23 |
| t-2 butene | 1.85 | 1.63 | 1.94 | 1.63 |
| Gasoline (C5-220° C.) | 40.26 | 43.66 | 37.25 | 37.10 |
| CO (220-370° C.) | 7.05 | 3.77 | 5.16 | 3.52 |
| CLO (>370° C.) | 3.16 | 2.14 | 2.46 | 1.48 |
| Coke | 0.99 | 2.15 | 0.94 | 2.83 |

Example—5

This example illustrates the process provided by the present subject matter for productions of higher light olefin yields by catalytic cracking of hydrocarbon using short contact time via changing the feed injector axial position from the bottom of the reactor so that larger the feed injector higher the contact time between catalyst and feed. The tests are carried out in a fixed fluid bed reactor at temperature of 580° C., with Catalysts-to-Oil ratio of 20, feed injection rate of 1.2 gram/min, and catalyst consist of 80% cat-A and 20% shape selective ZSM-5. It is seen that, 1.125" injection tube gives comparable yield pattern with a commercial riser reactor having contact time of 3 to 4 seconds and relative contact time of 2.125" injection tube is 0.6 times that of 1.125" injection tube (1.8 to 2.4 secs). The results of the tests are listed in Table 6. It can be observed that by decreasing contact time about 60%, coke and DG yields were decreased by 9.7% and 82% respectively. Further, coke yield per unit propylene is less in short injector.

TABLE 6

Effect of Contact Time

| Feedstock | UCO | UCO |
|---|---|---|
| Temperature, ° C. | 580 | 580 |
| C/O | 20 | 20 |
| WHSV($hr^{-1}$) | 6 | 6 |
| Base Cat | Cat-A | Cat-A |
| Additive | 20% | 20% |
| Injector location | 1.125" from bottom | 2.125" from bottom |

TABLE 6-continued

Effect of Contact Time

| Feedstock | UCO | UCO |
|---|---|---|
| | of the reactor | of the reactor |
| TOS(sec) | 30 | 30 |
| | Yields, wt % | |
| H2 | 0.05 | 0.05 |
| Methane | 1.83 | 1.59 |
| Ethane | 1.52 | 1.27 |
| Ethylene | 9.13 | 8.61 |
| Propane | 6.35 | 5.64 |
| Propylene | 19.70 | 19.38 |
| n-butane | 2.17 | 2.03 |
| Iso-butane | 8.13 | 7.64 |
| Isobutylene | 4.23 | 4.06 |
| C-2 butene | 3.26 | 3.20 |
| t-2 butene | 1.76 | 1.72 |
| Gasoline (C5-220° C.) | 31.30 | 34.88 |
| CO (220-370° C.) | 3.97 | 3.45 |
| CLO (>370° C.) | 1.19 | 1.60 |
| Coke | 5.415 | 4.89 |

Example—6

This example illustrates the effect of quantity of shape selective ZSM-5 catalyst in total catalyst on light olefin yield. The optimum dosage of shape selective catalyst is depends on feed type, base catalyst type, and operating conditions. In the current example this effect was studied for feed UCO, base catalyst cat-A at 580° C. There is no considerable increment in light olefin yield by increasing ZSM5 dosage from 20% to 40% as shown in table 7.

TABLE 7

Effect of additive in catalyst

| Feed | UCO | UCO |
|---|---|---|
| T ° C. | 580 | 580 |
| C/O | 9 | 9 |
| WHSV($hr^{-1}$) | 15 | 15 |
| Cat Wt (grams) | 9 | 9 |
| Base Cat | Cat-A | Cat-A |
| Additive in catalyst stream | 20% | 40% |
| Yields (wt. %) | | |
| $H_2$ | 0.02 | 0.04 |
| Methane | 1.01 | 1.07 |
| Ethane | 0.86 | 1.06 |
| Ethylene | 6.61 | 7.64 |
| Propane | 4.38 | 5.77 |
| Propylene | 19.02 | 18.26 |
| n-butane | 1.86 | 2.01 |
| Iso-butane | 6.72 | 5.73 |
| Isobutylene | 4.58 | 4.29 |
| C-2 butene | 3.57 | 3.22 |
| t-2 butene | 1.84 | 1.70 |
| Gasoline (C5-220° C.) | 41.23 | 39.34 |
| CO (220-370° C.) | 3.51 | 4.61 |
| CLO (>370° C.) | 2.63 | 3.16 |
| Coke | 2.18 | 2.12 |

Thus, the present subject matter provides various multi-stage catalytic cracking schemes for cracking of hydrocarbon feedstock to maximize light olefins production. In one implementation, the cracking process can include at least two stages in series wherein catalyst and hydrocarbon streams flow countercurrent to each other. The feed entry zone temperature can be lower than the product outlet temperature and the stages could be fluidized bed, downer, riser, cyclone type reactors or combination of thereof ensuring countercurrent contacting patterns between the catalyst and hydrocarbon streams. In various implementations, the individual stages can be designed such that the catalyst residence time in each stage can be varied.

In various implementations of the present subject matter, the multi-stage countercurrent reactors can be operated as follows:

i. The reactor where feed enters operates at temperatures ranging from 500° C. to 600° C. and the reactor where final product goes out operates at temperature ranging from 580° C.-700° C.
ii. Weight hourly space velocity (WHSV) ranging from 5 to 80 $hr^{-1}$.
iii. Reaction catalyst stream comprises of USY type catalyst, shape selective ZSM-5 and active matrix.
iv. The dosage of shape selective additive catalyst stream is in the range of 5-25 wt %.
v. The zeolite content in the additive and catalyst is in the range of 30-70 wt %.
vi. The catalyst contact time in the reactor where feed enters is in the range of 3-4 sec and in the reactor where final product goes out is in the range of 1-3 sec.
vii. The coke content of catalyst entering reactor where the fresh feed is introduced is at least 0.3 wt %.
viii. Cat-to-oil ratio in each stage is in the range of 6-20.
ix. Amount of steam to reduce hydrocarbon partial pressure in the reactor where the final product goes out is in the range of 15-45 wt % of the hydrocarbon feed in that particular stage.

It will be understood that the operating conditions provided above are only as examples and depending on the implementation of the design and configuration of the multistage countercurrent reactors and desired reaction products, the operating conditions can be suitably changed and different advantages can be obtained as will be evident to a person skilled in the art upon reading the present subject matter. A comparison of the operating conditions that can be used by the present subject matter and the operating conditions that are required by conventional co-current schemes are provided in Table 8 below. As is evident, it is possible to use more favorable operating conditions for higher selectivity of light olefin production as per the proposed counter current scheme of the present subject matter.

TABLE 8

Comparison of operating conditions

| | Conventional Co-current | | Proposed Counter current Present |
|---|---|---|---|
| | Riser | Downer | Subject Matter |
| Temperature inlet | High | High | Low |
| Temperature outlet | Low | Low | High |
| Coke inlet | Low | Low | High |
| Crackable Carbon in Feed at inlet where it contacts regenerated catalyst | High | High | Low |
| Crackable Carbon in Feed at outlet where it contacts spent catalyst | Low | Low | High |
| Hydrogen transfer reaction at inlet (where regenerated catalyst contacts feed) | High | High | Low |
| Hydrogen transfer reaction at outlet (where spent catalyst contacts feed) | Low | Low | High |
| Conversion at inlet | High | High | Low |
| Overall conversion | Low | Low | High |
| Light olefin selectivity at inlet | High | High | Low |
| Overall light olefin selectivity | Low | Low | High |

Further, other embodiments of the present subject matter will be apparent from consideration of the present specification. It is intended that the present specification and examples be considered as illustrative only and as encompassing the equivalents thereof. For example, there can be three or more stages operating in an overall countercurrent manner, such that feed intake is at the first stage and catalyst intake is at the last stage. Further, catalyst can be made to flow downwards under gravitational flow, thus eliminating requirements of pumping of the catalyst, etc. Moreover, since catalyst flow is countercurrent to reactant feed, it can result in in-situ separation of products, leading to improved olefin selectivity.

Further, in case the multi-stages include a fluid bed, greater catalyst density can be used with substantially constant cat-to-oil ratio throughout the bed. As a result, higher conversions and olefins production, higher catalytic cracking, and less gas make can be achieved. In addition, as per the schemes of the present subject matter, there are smaller temperature changes in fluid bed due to lesser back mixing of catalyst and more catalyst inventory. Further highest temperatures in fluid bed system are at the exit. By connecting fluid bed reactors with a cyclone reactor at the end reduces the residence time in last stage, where the hot catalyst feed enters the process, and so exposure time to high temperature is reduced. As a result, thermodynamically more favorable olefins selectivity is achieved.

In one implementation, in a stage wise countercurrent system, the contact time in the hot stage at entry of the catalyst can be even better controlled by using short contact time reactor, such as a cyclone reactor or through a series of cyclones. In another implementation, low temperature dense bed cracking can be accomplished in a low temperature fluid bed reactor. In one example, to maximize the low temperature reactor productivity, the dense bed flow pattern could be designed as a plug flow system using appropriate baffles or internals so that back-mixing is minimized and temperature gradient is still maintained along the length. In another example, a series of dense fluid bed systems can be used. Further, it is also possible to quench the outgoing product gases rapidly optionally to arrest further cracking.

Further, to moderate the exit product gas temperatures, various other configurations can be conceived, such as splitting of regenerated catalyst and using a portion of the regenerated catalysts for olefins cracking while the balance is fed to a normal riser system. Alternatively, the regenerated catalyst can be mixed with spent catalyst and used in a countercurrent scheme. Similar other combinations of conventional processes and multi-stage counter current configuration may be created based on the description provided herein, and are intended to be covered in the scope of the present subject matter.

The present subject matter also provides more flexibility to design stages as a combination of cyclone, riser, downer, and fluid bed and with better gas make control. As there is only one catalyst lift from bottom of the last stage reactor to first stage reactor after regeneration, the schemes are energy efficient. The reactors may operate in continuous stirred tank reactor (CSTR) manner due to the continuous mixing that takes place as a result of the catalyst and feed flow, providing better temperature control and eliminating/reducing the need for external component for better temperature control. Moreover, as high catalyst loading can be used more conversion can be obtained. In one example, a total residence time of 500-4000 msec (sum of residence times in all stages) can be maintained depending on the configuration and the optimum residence time can be selected for cracking.

Although implementations for multi-stage countercurrent reactor schemes for FCC reactions have been described in language specific to structural features and/or methods, it is to be understood that the present subject matter is not necessarily limited to the specific features or methods described. Rather, the specific features and methods are disclosed as examples of the present subject matter.

We claim:

1. A method for catalytic cracking, the method comprising:

introducing a hydrocarbon feed into a bottom stage reactor of a plurality of reactor stages, wherein the hydrocarbon feed flows successively from the bottom stage reactor to a top stage reactor in an upward direction;

introducing a reaction catalyst stream into the top stage reactor of the plurality of reactor stages, wherein the reaction catalyst stream flows successively from the top stage reactor to the bottom stage reactor in a downward direction without intermediate removal of spent catalyst for regeneration; and in each of the plurality of reactor stages, allowing the hydrocarbon feed received at a particular reactor to come in contact with the reaction catalyst stream received at the particular reactor for cracking of the hydrocarbon feed;

allowing the hydrocarbon feed including cracked products to exit the particular reactor in the upward direction to the next stage reactor; and allowing the reaction catalyst stream including spent catalyst to exit the particular reactor in the downward direction to the next stage reactor, wherein a final cracked product stream is obtained at an outlet of the top stage reactor and a final spent catalyst stream is obtained at an outlet of the bottom stage reactor, wherein the final spent catalyst stream is sent to a regenerator for regeneration.

2. The method as claimed in claim 1, wherein the final cracked product stream comprises a hydrocarbon fraction lighter than feed hydrocarbons.

3. The method as claimed in claim 1, wherein the hydrocarbon feed comprises at least one of a $C_4$ hydrocarbon fraction, a naphtha fraction, and a heavy hydrocarbon fraction.

4. The method as claim in claim 1, wherein the bottom stage reactor and the top stage reactor are operable at a first pre-determined temperature and second pre-determined temperature respectively, and wherein the second pre-determined temperature is lesser than the first pre-determined temperature.

5. The method as claimed in claim 4, wherein the first pre-determined temperature is in the range of 580° C.-700° C.

6. The method as claimed in claim 4, wherein the second pre-determined temperature is in the range of 500° C.-600° C.

7. The method as claimed in claim 1, wherein, in each reactor of the plurality of reactor stages, the hydrocarbon feed and the reaction catalyst stream are allowed to come in contact for a respective pre-defined contact time.

8. The method as claimed in claim 7, wherein the pre-defined contact time in the bottom stage reactor is in a range of 3 to 4 seconds.

9. The method as claimed in claim 7, wherein the pre-defined contact time in the top stage reactor is in a range of 1 to 3 sec.

10. The method as claimed in claim 1, wherein the reaction catalyst stream comprises of one of a USY type catalyst, shape selective ZSM-5, and active matrix.

11. The method as claimed in claim 1, wherein the reaction catalyst stream is a shape selective additive catalyst stream.

12. The method as claimed in claim 11, wherein the dosage of shape selective additive catalyst stream is in the range of 5-35 wt. %.

13. The method of claimed in claim 11, wherein the zeolite content of the shape selective additive catalyst stream is 30-70 wt. %.

14. The method as claimed in claim 1, wherein the Weight Hourly Space Velocity (WHSV) ranges from 5-80 $hr^{-1}$.

15. The method as claimed in claim 1, wherein the catalyst-to-oil ratio is in the range of 6-20.

* * * * *